US008247362B2

(12) United States Patent
Murphy et al.

(10) Patent No.: US 8,247,362 B2
(45) Date of Patent: Aug. 21, 2012

(54) LIGHT DUTY LIQUID CLEANING COMPOSITIONS AND METHODS OF MANUFACTURE AND USE THEREOF

(75) Inventors: Cynthia McCullar Murphy, Belle Meade, NJ (US); Gregory Szewczyk, Flemington, NJ (US); David Frank Suriano, Edison, NJ (US); Julie Burke, Somerset, NJ (US)

(73) Assignee: Colgate-Palmolive Company, New York, NY (US)

( * ) Notice: Subject to any disclaimer, the term of this patent is extended or adjusted under 35 U.S.C. 154(b) by 115 days.

(21) Appl. No.: 12/808,376

(22) PCT Filed: Jun. 17, 2009

(86) PCT No.: PCT/US2009/047604

§ 371 (c)(1),
(2), (4) Date: Jun. 16, 2010

(87) PCT Pub. No.: WO2009/155314

PCT Pub. Date: Dec. 23, 2009

(65) Prior Publication Data

US 2011/0230385 A1 Sep. 22, 2011

Related U.S. Application Data

(63) Continuation-in-part of application No. 12/140,806, filed on Jun. 17, 2008, now abandoned.

(51) Int. Cl.
*C11D 17/00* (2006.01)

(52) U.S. Cl. ..... 510/218; 510/424; 510/426; 510/428; 510/463

(58) Field of Classification Search ..... None
See application file for complete search history.

(56) References Cited

U.S. PATENT DOCUMENTS 3,658,985 A 4/1972 Olson, Jr.
3,676,340 A 7/1972 Berg et al.
3,769,398 A 10/1973 Hewitt
3,935,129 A 1/1976 Jabalee
3,982,892 A 9/1976 Gray
4,013,787 A 3/1977 Varlerberghe et al.
4,129,515 A 12/1978 Foster
4,154,706 A 5/1979 Kenkare et al.
4,224,195 A 9/1980 Kawasaki et al.
4,259,204 A 3/1981 Homma
4,329,334 A 5/1982 Su et al.
4,329,335 A 5/1982 Su et al.
4,329,336 A 5/1982 Su et al.
4,450,091 A 5/1984 Schmolka
4,595,526 A 6/1986 Lai
5,130,056 A 7/1992 Jakobson et al.
5,192,460 A 3/1993 Thomas et al.
5,294,364 A 3/1994 Thomas et al.
5,437,809 A 8/1995 Chaudhuri
5,531,938 A 7/1996 Erilli
5,554,320 A 9/1996 Yianakopoulos
5,741,769 A 4/1998 Erilli
5,914,300 A 6/1999 Fujiwara et al.
5,962,388 A 10/1999 Sherry et al.
5,968,539 A 10/1999 Beerse et al.
6,010,992 A 1/2000 Arvanitidou et al.
6,046,146 A 4/2000 Erilli
6,046,150 A 4/2000 Choy et al.
6,048,834 A 4/2000 Drapier et al.
6,051,542 A 4/2000 Pollack et al.
6,071,866 A * 6/2000 Fujiwara et al. ..... 510/130
6,121,228 A 9/2000 Drapier et al.
6,136,769 A 10/2000 Asano et al.
6,147,039 A 11/2000 Jacques et al.
6,156,296 A 12/2000 Riedel et al.
6,159,925 A 12/2000 Blandiaux
6,251,844 B1 6/2001 Leonard et al.
6,255,269 B1 7/2001 Leonard et al.
6,262,003 B1 7/2001 Leonard et al.
6,268,330 B1 7/2001 Leonard et al.
6,291,419 B1 9/2001 D'Ambrogio et al.
6,306,817 B1 10/2001 Kott et al.
6,313,084 B1 11/2001 D'Ambrogio et al.
6,339,055 B1 1/2002 Brooker et al.
6,361,768 B1 3/2002 Galleguillos et al.
6,441,037 B1 8/2002 Arvanitidou et al.
6,444,636 B1 9/2002 Toussaint et al.
6,475,967 B1 11/2002 Arvanitidou et al.
6,495,507 B1 12/2002 Arvanitidou
6,534,472 B1 3/2003 Arvanitidou et al.
6,537,952 B2 3/2003 Hayward et al.
6,537,955 B1 3/2003 Raso et al.
6,541,436 B1 4/2003 Arvanitidou et al.

(Continued)

FOREIGN PATENT DOCUMENTS

EP 0 250 181 A2 6/1987

(Continued)

OTHER PUBLICATIONS

File History U.S. Appl. No. 12/140,795.
File History U.S. Appl. No. 12/140,754.
File History U.S. Appl. No. 12/140,811.
File History PCT Serial No. PCT/US2008/067219.
File History PCT Serial No. PCT/US2008/067220.
File History PCT Serial No. PCT/US2008/067228.
International Search Report for PCT/US2009/047595.
International Search Report for PCT/US2009/047603.
International Search Report for PCT/US2009/047601.
International Search Report PCT/US2008/067219.
International Search Report PCT/US2008/067220.
International Search Report PCT/US2008/067228.
PAIC Anti-bacterial washing up liquid http://www.gnpd.com.
A portion of the file history for U.S. Appl. No. 12/140,754 since Jun. 16, 2010.
The file history for co-pending U.S. Appl. No. 12/997,622, Dec. 2010.

(Continued)

*Primary Examiner* — Necholus Ogden, Jr.
(74) *Attorney, Agent, or Firm* — Michael F. Morgan

(57) ABSTRACT

The invention encompasses liquid cleaning compositions, for example, dish washing liquids, and methods of their manufacture and use, which possess enhanced cleaning ability. The cleaning compositions of the invention include acidic light duty liquid cleaning compositions with low toxicity and anti-bacterial efficacy on surfaces, for example, hard surfaces.

8 Claims, No Drawings

U.S. PATENT DOCUMENTS

| | | | |
|---|---|---|---|
| 6,551,980 | B1 | 4/2003 | Wisniewski et al. |
| 6,583,178 | B2 | 6/2003 | D'Ambrogio et al. |
| 6,586,014 | B2 | 7/2003 | Arvanitidou et al. |
| 6,593,284 | B2 | 7/2003 | Arvanitidou et al. |
| 6,605,579 | B1 | 8/2003 | Arvanitidou et al. |
| 6,617,296 | B1 | 9/2003 | Connors et al. |
| 6,627,589 | B1 | 9/2003 | Arvanitidou |
| 6,696,399 | B1 | 2/2004 | Chernin et al. |
| 6,733,986 | B1 | 5/2004 | Armstrong et al. |
| 6,815,406 | B1 | 11/2004 | Szewczyk |
| 6,821,939 | B1 | 11/2004 | Szewczyk et al. |
| 6,884,764 | B2 | 4/2005 | Szewczyk et al. |
| 6,914,038 | B2 | 7/2005 | Terazaki et al. |
| 7,033,986 | B2 | 4/2006 | Szewczyk |
| 7,470,653 | B2 | 12/2008 | Gambogi et al. |
| 7,749,332 | B2 | 7/2010 | Jonke et al. |
| 2003/0144218 | A1 | 7/2003 | Arvanitidou et al. |
| 2003/0147822 | A1 | 8/2003 | Doi et al. |
| 2003/0170197 | A1 | 9/2003 | Terazaki et al. |
| 2004/0101504 | A1 | 5/2004 | Kinscherf et al. |
| 2004/0204331 | A1 | 10/2004 | Connors et al. |
| 2004/0229763 | A1 | 11/2004 | Hutton, III et al. |
| 2004/0229766 | A1 | 11/2004 | Hutton, III et al. |
| 2004/0229767 | A1 | 11/2004 | Ford et al. |
| 2004/0229963 | A1 | 11/2004 | Culeron et al. |
| 2004/0254253 | A1 | 12/2004 | Culeron et al. |
| 2005/0019161 | A1 | 1/2005 | Ichikawa et al. |
| 2005/0031570 | A1 | 2/2005 | Grit et al. |
| 2005/0049161 | A1 | 3/2005 | Szewczyk |
| 2005/0049170 | A1 | 3/2005 | Szewczyk |
| 2005/0100621 | A1 | 5/2005 | Popp et al. |
| 2005/0192196 | A1 | 9/2005 | Hutton, III et al. |
| 2006/0079420 | A1 | 4/2006 | Wagner et al. |
| 2006/0115440 | A1 | 6/2006 | Arata et al. |
| 2006/0198807 | A1 | 9/2006 | Morioka |

FOREIGN PATENT DOCUMENTS

| | | | |
|---|---|---|---|
| EP | 1076554 | | 10/2004 |
| WO | 94/11476 | A1 | 5/1994 |
| WO | 00/66079 | A1 | 11/2000 |
| WO | 01/79404 | A1 | 10/2001 |
| WO | 02/092743 | A1 | 11/2002 |
| WO | 03/097779 | A1 | 11/2003 |

OTHER PUBLICATIONS

Horeca Select, 2008, Detergente Piatti Igienizzante Concentrato Horaca Select, Technical and Safety Data Sheet.

PZ Cussons UK Ltd., 2008, Morning Fresh Ingredient Data.

Cantini Raffaello SNC, 2008, Nuovo Piu' Piatti, Card of the Ingredients.

The file history for co-pending U.S. Appl. No. 12/997,622 generated Apr. 26, 2012.

Statement of Grounds of Opposition from Australian Patent Application No. 2009260264, dated Mar. 1, 2012.

* cited by examiner

LIGHT DUTY LIQUID CLEANING COMPOSITIONS AND METHODS OF MANUFACTURE AND USE THEREOF

CROSS REFERENCE TO RELATED APPLICATIONS

This application is a continuation in part application of U.S. Ser. No. 12/140,806, filed on 17 Jun. 2008, which is incorporated herein by reference.

BACKGROUND OF THE INVENTION

Light duty liquid cleaning compositions should be designed with acceptable foaming and cleaning properties. Such cleaning compositions should maintain acceptable cleaning performance, have ease of rinsing, and contain a low level of dye mix that yields a near colorless visual appearance. Light duty liquid cleaning compositions should include an ingredient mix that increases utilization of naturally derived ingredients, results in a cleaned surface with minimal spotting and is both mild and hypoallergenic. Light duty liquid cleaning compositions should also be designed to be biodegradeable and not to leave any harmful residue on surfaces.

Accordingly, the inventors of the invention have developed light duty liquid cleaning compositions, which are suitable for disinfecting all types of surfaces including animate surfaces (e.g., human skin and/or mouth when used as an oral preparation or toothpaste) and inanimate surfaces. This technology is suitable for use on delicate surfaces including those surfaces in contact with food in a safe manner. Moreover, the light duty liquid cleaning compositions according to the invention reduce the amount of chemical residues left on a surface disinfected therewith. Thus, it may be not necessary to rinse, for example, a surface after the compositions of the invention have been applied thereto in diluted conditions. The inventors have developed compositions and methods that include cleaning compositions with enhanced cleaning possessing antibacterial efficacy and low toxicity.

BRIEF SUMMARY OF THE INVENTION

The invention encompasses acidic liquid cleaning compositions designed for cleaning surfaces including hard surfaces, which deliver acceptable cleaning and foaming performance and exhibit ease of rinsing while leaving low amounts residue.

The inventors have surprisingly found that cleaning compositions including a combination of one or more of anionic surfactants, a zwitterionic surfactant and an acid in specific amounts have antibacterial activity while at the same time having low toxicity. In certain embodiments, the cleaning composition is a colorless liquid.

In one embodiment the invention encompasses cleaning compositions including an acidic formulation that exhibits ease of rinsing, which assists with the removal of residue while exhibiting antibacterial efficacy.

In other embodiments, the invention encompasses cleaning compositions including a surfactant based cleaning composition comprising at least one anionic surfactant, at least one zwitterionic surfactant, and at least one organic acid, wherein the composition has a $\log_{10}$ reduction in microbes of at least about 3 when a surface containing bacteria is contacted with the composition for about 30 seconds at 25° C., wherein the composition is stable for at least about 1 year at room temperature, and wherein the composition has a low toxicity. An exemplary cleaning composition contains up to about 10 wt.

% of an alkyl benzene sulfonate, between about 5 wt/. % and about 30 wt. % of an alkyl ether sulfate, between about 3 wt. % and about 10 wt. % of a betaine, and between about 1 wt. % and about 3 wt. % of lactic acid, based on the total weight of the composition.

In certain embodiments, the invention encompasses a cleaning composition including a first anionic surfactant wherein the first anionic surfactant is present in an amount of about 3 wt. % to about 10 wt. % by weight of the total composition, a second anionic surfactant, wherein the second anionic surfactant is present in an amount of about 2 wt. % to about 30 wt. % by weight of the total composition, at least one zwitterionic surfactant, wherein the zwitterionic surfactant is present in an amount of about 1 wt. % to about 8 wt. % by weight of the total composition, and lactic acid, wherein the lactic acid is present in an amount of about 1 wt. % to about 2.5 wt. % by weight of the total composition.

In certain embodiments, the invention encompasses compositions including a first anionic surfactant wherein the first anionic surfactant is present in an amount of about 5 wt. % to about 10 wt. % by weight of the total composition, a second anionic surfactant, wherein the second anionic surfactant is present in an amount of about 5 wt. % to about 28 wt. % by weight of the total composition, at least one zwitterionic surfactant, wherein the zwitterionic surfactant is present in an amount of about 2 wt. % to about 8 wt. % by weight of the total composition, and at least one acid, wherein the acid is present in an amount of about 1 wt. % to about 3 wt. % by weight of the total composition.

In certain embodiments, the invention encompasses compositions including a first anionic surfactant wherein the first anionic surfactant is present in an amount of about 5 wt. % to about 9 wt. % by weight of the total composition, a second anionic surfactant, wherein the second anionic surfactant is present in an amount of about 9 wt. % to about 20 wt. % by weight of the total composition, at least one zwitterionic surfactant, wherein the zwitterionic surfactant is present in an amount of about 1 wt. % to about 7 wt. % by weight of the total composition, and at least one acid, wherein the acid is present in an amount of about 2 wt. % by weight of the total composition.

In certain embodiments, the invention encompasses compositions including a first anionic surfactant wherein the first anionic surfactant is present in an amount of about 2 wt. % to about 5 wt. % by weight of the total composition, a second anionic surfactant, wherein the second anionic surfactant is present in an amount of about 5 wt. % to about 8 wt. % by weight of the total composition, at least one zwitterionic surfactant, wherein the zwitterionic surfactant is present in an amount of about 1 wt. % to about 3 wt. % by weight of the total composition, and at least one acid, wherein the acid is present in an amount of about 2 wt. % by weight of the total composition.

In certain embodiments, the invention encompasses an acidic liquid cleaning composition designed for cleaning hard surfaces as well as glass surfaces and effective in removing grease soil and/or other soil.

In other embodiments, the invention encompasses cleaning compositions including a first anionic surfactant wherein the first anionic surfactant is present in an amount of about 4 wt. % by weight of the total composition, a second anionic surfactant, wherein the second anionic surfactant is present in an amount of about 12 wt. % by weight of the total composition, at least one zwitterionic surfactant, wherein the zwitterionic surfactant is present in an amount of about 3.5 wt. % by weight of the total composition, and at least one acid; wherein the acid is present in an amount of about 2 to about 2.5 wt. % by weight of the total composition.

In other embodiments, the invention encompasses cleaning compositions including a first anionic surfactant wherein the first anionic surfactant is present in an amount of about 6 wt. % by weight of the total composition, a second anionic surfactant, wherein the second anionic surfactant is present in an amount of about 20 wt. % by weight of the total composition, at least one zwitterionic surfactant, wherein the zwitterionic surfactant is present in an amount of about 7 wt. % by weight of the total composition, and at least one acid, wherein the acid is present in an amount of about 2 wt. % by weight of the total composition.

In other embodiments, the invention encompasses cleaning compositions including a first anionic surfactant wherein the first anionic surfactant is present in an amount of about 8.5 wt. % by weight of the total composition, a second anionic surfactant, wherein the second anionic surfactant is present in an amount of about 18 wt. % by weight of the total composition, at least one zwitterionic surfactant, wherein the zwitterionic surfactant is present in an amount of about 5.5 wt. % by weight of the total composition, and at least one acid, wherein the acid is present in an amount of about 2 wt. % by weight of the total composition.

In another embodiment, the invention encompasses cleaning compositions including a first anionic surfactant wherein the first anionic surfactant is present in an amount of about 5.7 wt. % by weight of the total composition, a second anionic surfactant, wherein the second anionic surfactant is present in an amount of about 19.5 wt. % by weight of the total composition, at least one zwitterionic surfactant, wherein the zwitterionic surfactant is present in an amount of about 6.5 wt. % by weight of the total composition, and at least one acid, wherein the acid is present in an amount of about 2 wt. % by weight of the total composition.

Another embodiment of the invention encompasses cleaning compositions including dodecyl benzene sulfonate is present in an amount of about 5 wt. % to about 10 wt. % by weight of the total composition, lauryl ether sulfate with about two EO units is present in an amount of about 5 wt. % to about 20 wt. % by weight of the total composition, a betaine, wherein the zwitterionic surfactant is present in an amount of about 3 wt. % to about 8 wt. % by weight of the total composition, and lactic acid, wherein the acid is present in an amount of about 1 wt. % to about 3 wt. % by weight of the total composition.

Another embodiment of the invention encompasses cleaning compositions including a sodium salt of dodecyl benzene sulfonate, which is present in an amount of up to about 10 wt. %, preferably up to about 7 wt. %, by weight of the total composition; a sodium salt of lauryl ether sulfate with about two EO units, which is present in an amount of about 5 wt. % to about 30 wt. % by weight of the total composition; a betaine, which is present in an amount of about 3 wt. % to about 8 wt. % by weight of the total composition; and lactic acid, which is present in an amount of about 1 wt. % to about 3 wt. % by weight of the total composition.

Another embodiment of the invention encompasses cleaning compositions including an alkyl ether sulfate, which is present in an amount of about 5 wt. % to about 40 wt. % by weight of the total composition, and a zwitterionic surfactant, which is present in an amount of about 1 wt. % to about 8 wt. % by weight of the total composition; and lactic acid, which is present in an amount of about 1 wt. % to about 3 wt. % by weight of the total composition.

Another embodiment of the invention encompasses cleaning compositions including a sodium salt of an alkyl ether sulfate, which is present in an amount of about 5 wt. % to about 40 wt. % by weight of the total composition, and a betaine, which is present in an amount of about 1 wt. % to about 8 wt. % by weight of the total composition; and lactic acid, which is present in an amount of about 1 wt. % to about 3 wt. % by weight of the total composition.

Another embodiment of the invention encompasses a method of making a liquid cleaning composition designed for cleaning surfaces including hard surfaces and effective in removing soil, which includes combining a first anionic surfactant wherein the first anionic surfactant is present in an amount of about 5 wt. % to about 10 wt. % by weight of the total composition, a second anionic surfactant, wherein the second anionic surfactant is present in an amount of about 5 wt. % to about 15 wt. % by weight of the total composition, at least one zwitterionic surfactant, wherein the zwitterionic surfactant is present in an amount of about 3 wt. % to about 8 wt. % by weight of the total composition, and at least one acid, wherein the acid is present in an amount of about 1 wt. % to about 3 wt. % by weight of the total composition.

Another embodiment of the invention encompasses a method of removing soil and killing bacteria, which includes contacting the surface with a composition including a first anionic surfactant wherein the first anionic surfactant is present in an amount of about 3 wt. % to about 10 wt. % by weight of the total composition, a second anionic surfactant, wherein the second anionic surfactant is present in an amount of about 5 wt. % to about 18 wt. % by weight of the total composition, at least one zwitterionic surfactant, wherein the zwitterionic surfactant is present in an amount of about 2 wt. % to about 8 wt. % by weight of the total composition, and at least one acid, wherein the acid is present in an amount of about 1 wt. % to about 3 wt. % by weight of the total composition.

To achieve the foregoing and other embodiments and in accordance with the purpose of the invention, as embodied and broadly described herein the light duty liquid detergent of this invention includes at least one anionic surfactant, at least one zwitterionic surfactant, and at least one acidic component, which has both good disinfecting properties on hard surfaces and good food soil and/or other soil removal and leaves surfaces with a shiny appearance.

As a particularly desirable embodiment, the cleaning composition does not contain ingredients that are not biologically or ecologically favorable. A preferred cleaning composition of the invention can be characterized as containing no or no significant amount of extraneous preservatives and antimicrobial compounds, other than the acidic component. The term "no significant amount" as used herein indicates a content concentration that is less than an efficacious amount to achieve the intended purpose. Preferably, the cleaning composition contains less than 1 wt. %, preferably 0.5 wt. %, of a magnesium or ammonium salt of an anionic surfactant, based on the total weight of the composition. Particularly preferred cleaning composition can be characterized as containing only ecologically acceptable solvents such as water and one or more of alkanols, e.g., ethanol, isopropanol and propanol. The cleaning composition is not an emulsion or microemulsion composition. A preferred cleaning composition can also be characterized as colorless or nearly colorless. A colorless or nearly colorless composition is highly desirable since the composition can be easily rendered to have any desirable color by adding colorants or dyes to the colorless or nearly colorless composition.

The compositions have utility in a broad range of applications including, for example, in consumer product fluids such as surface cleaners, cleansers and the like. The compositions are highly suitable for cleaning surfaces that are designed for food-contact uses, such as dishes, silverware, glasses and cups.

DETAILED DESCRIPTION OF THE INVENTION

As used throughout, ranges are used as a shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

The cleaning compositions of the invention are useful as ultra and regular density dish liquid formulas designed for several key formula characteristics including, but not limited to, antibacterial efficacy from a naturally-derived organic acid, at minimum about a 3-log reduction in about 30 seconds for both Gram-positive (e.g., *Staphylococcus aureus*) and Gram-negative (e.g., *Salmonella enterica, E. coli*) on surfaces, minimal toxicity of inert (non-antibacterial) cleaning materials in the formulation, minimize corrosivity to processing equipment, competitive or superior foaming/cleaning performance with existing commercial cleaning products, competitive or superior rinsing and/or shine performance with existing products, and delivery of both active and aesthetic product stability performance over product lifetime.

Accordingly, the invention encompasses cleaning compositions including a surfactant based cleaning composition comprising at least one anionic surfactant, at least one zwitterionic surfactant, and at least one organic acid, wherein the composition has a $\log_{10}$ reduction in bacteria of at least about 3 when a surface containing bacteria is contacted with the composition for about 30 seconds at 25° C., wherein the composition is stable for at least about 1 year at room temperature, and wherein the composition has a low toxicity. According to the invention, a preferred cleaning composition of the invention can be characterized as containing no or no significant amount of extraneous preservatives and antimicrobial compounds, other than the organic acid. Extraneous preservative and antimicrobial compounds that are typically included in a cleaning composition include hydrogen peroxide, biguanide, triclosan, chlorophenol, paraben, zinc compounds, glutaraldehyde, and formaldehyde. The preferred cleaning composition provides efficacious antimicrobial properties without the use of extraneous preservative and antimicrobial compounds.

In certain embodiments, the organic acid is lactic acid.

In certain embodiments, at least one anionic surfactant is present in an amount of about 3 wt. % to about 30 wt. % by weight of the total composition.

In certain embodiments, at least one zwitterionic surfactant, wherein the zwitterionic surfactant is present in an amount of about 1 wt. % to about 8 wt. % by weight of the total composition.

In certain embodiments, at least one organic acid is present in an amount of about 1 wt. % to about 3 wt. % by weight of the total composition.

In certain embodiments, the anionic surfactant is a $C_{10}$-$C_{14}$ linear alkyl sulfonate.

In certain embodiments, the anionic surfactant is sodium lauryl ether sulfate with about two ethylene oxide units.

In certain embodiments, the zwitterionic surfactant is laurylamidopropyl betaine.

In certain embodiments, the anionic surfactants and/or the zwitterionic surfactants are derived from a natural source and biodegradable surfactants.

In other embodiments, the invention encompasses a cleaning composition comprising a first anionic surfactant wherein the first anionic surfactant is present in an amount of about 6 wt. % by weight of the total composition, a second anionic surfactant, wherein the second anionic surfactant is present in an amount of about 20 wt. % by weight of the total composition, at least one zwitterionic surfactant, wherein the zwitterionic surfactant is present in an amount of about 7 wt. % by weight of the total composition, and lactic acid, wherein the lactic acid is present in an amount of about 2 wt. % by weight of the total composition.

In other embodiments, the invention encompasses a cleaning composition comprising a first anionic surfactant wherein the first anionic surfactant is present in an amount of up to about 10 wt. %, preferably up to about 7 wt. %, by weight of the total composition, a second anionic surfactant, wherein the second anionic surfactant is present in an amount between about 12 wt. % and about 30 wt. % by weight of the total composition, at least one zwitterionic surfactant, wherein the zwitterionic surfactant is present in an amount between about 3 wt. % and about 7 wt. % by weight of the total composition, and lactic acid, wherein the lactic acid is present in an amount of about 2 wt. % by weight of the total composition. For example, a suitable cleaning composition may contain about 6 wt. % of sodium dodecyl benzene sulfonate, about 20 wt. % of sodium pareth sulfate, about 7 wt. % of laurylamidopropyl betaine, and about 2 wt. % of lactic acid, based on the total weight of the composition.

In other embodiments, the invention encompasses a cleaning composition comprising a first anionic surfactant wherein the first anionic surfactant is present in an amount of about 8 wt. % by weight of the total composition, a second anionic surfactant, wherein the second anionic surfactant is present in an amount of about 18 wt. % by weight of the total composition, at least one zwitterionic surfactant, wherein the zwitterionic surfactant is present in an amount of about 5.5 wt. % by weight of the total composition, and lactic acid, wherein the lactic acid is present in an amount of about 2 wt. % by weight of the total composition.

In other embodiments, the invention encompasses a cleaning composition comprising dodecyl benzene sulfonate is present in an amount of about 3 wt. % to about 10 wt. % by weight of the total composition, lauryl ether sulfate with about two EO units is present in an amount of about 3 wt. % to about 20 wt. % by weight of the total composition, laurylamidopropyl betaine, preferably a sodium salt, wherein the zwitterionic surfactant is present in an amount of about 1 wt. % to about 8 wt. % by weight of the total composition, and lactic acid, wherein the acid is present in an amount of about 1 wt. % to about 3 wt. % by weight of the total composition.

In a preferred embodiment, the invention encompasses a cleaning composition comprising a sodium salt of dodecyl benzene sulfonate is present in an amount of about 3 wt. % to about 10 wt. % by weight of the total composition, a sodium salt of lauryl ether sulfate with about two EO units is present in an amount of about 3 wt. % to about 20 wt. % by weight of the total composition, laurylamidopropyl betaine, wherein the zwitterionic surfactant is present in an amount of about 1 wt. % to about 8 wt. % by weight of the total composition, and lactic acid, wherein the acid is present in an amount of about 1 wt. % to about 3 wt. % by weight of the total composition.

In other embodiments, the invention encompasses a cleaning composition including an anionic surfactant, which is present in an amount of about 5 wt. % to about 40 wt. % by weight of the total composition, and a zwitterionic surfactant, which is present in an amount of about 1 wt. % to about 8 wt. % by weight of the total composition, and lactic acid, which is present in an amount of about 1 wt. % to about 3 wt. % by weight of the total composition.

In a preferred embodiment, the invention encompasses cleaning compositions including a sodium salt of an alkyl ether sulfate, which is present in an amount of about 5 wt. % to about 40 wt. % by weight of the total composition, and a betaine, which is present in an amount of about 1 wt. % to about 8 wt. % by weight of the total composition, and lactic acid, which is present in an amount of about 1 wt. % to about 3 wt. % by weight of the total composition.

The invention also encompasses methods of cleaning a surface including contacting the surface with a composition of the invention, diluted or undiluted. The cleaning compositions possess antibacterial efficacy from an acid, for example lactic acid. In certain embodiments, the acid is a naturally-derived, weak-organic acid manufactured from renewable plant resources via microbial fermentation. In other embodiments, the acid is natural and readily biodegradable, non-toxic to the environment, and a natural product. In other embodiments, the surfactant is natural and readily biodegradable, non-toxic to the environment, and a natural product.

As used herein the phrase "from a natural source" refers to surfactants that have a natural origin and are derived from, for example, crops, animal fats and/or trees. These are also referred to in the art as oleochemical surfactants and are derived from sources including but not limited to plant oils such as palm, palm kernel or coconut oil, or from animal fats such as tallow, lard or fish oil. This is in contrast to petroleum or petrochemical surfactants derived from, for example, crude oil.

As used herein, the term "biodegradable surfactants" refers to surfactant-based cleaning ingredients that are designed to be used with water and disposed of down the drain. There they combine with other wastes for treatment in either a municipal treatment plant or a household septic tank system. During treatment, microorganisms biodegrade surfactants and other organic materials, ultimately breaking them down into carbon dioxide, water and minerals. Any small amounts of surfactants that remain after treatment continue to biodegrade in the environment. In certain embodiments, the surfactants of the invention biodegrade quickly and thoroughly and do not present a risk to organisms living in the environment.

The cleaning compositions of the invention, diluted or undiluted, result in a minimum 3-log reduction in about 30 seconds or about one minute of both Gram-positive (e.g., *Staphylococcus aureus*) and Gram-negative (e.g., *Salmonella enterica, E. coli*) bacteria, or run-off solutions. Without being limited by theory, the inventors believe that the cleaning compositions of the invention, which include an acid result in the acid crossing the bacterial cell membrane in its protonated or charge-neutral form. Lactic acid with a pKa of about 3.8 (the point at which half of the molecules are protonated and half are not protonated) is effective at a pH below 3.5. In certain embodiments, the recommended pH for the cleaning compositions of the invention for maximal efficacy balanced against safety is about 3.25. Without being limited by theory, the mechanism of action for lactic acid is thought to be two-fold: (1) as protonated molecules cross the bacterial membrane they become deprotonated at the internal pH of the cell and progressively lower the internal bacterial cell pH that can lead to protein deformation and halt critical cellular processes, but (2) this change in internal pH can act to collapse the delta psi gradients critical to microbial nutrient and energy transport systems in the bacterial cell membrane—also leading to a cut-off of critical nutrients and energy sources.

Anionic Surfactants

In certain embodiments, the compositions of the invention include one or more anionic surfactants. The anionic surfactants, which may be used in the compositions of the invention include water soluble anionic sulfonate surfactants and include sodium salts of linear $C_8$-$C_{16}$ alkyl benzene sulfonates; $C_{10}$-$C_{20}$ paraffin sulfonates, alpha olefin sulfonates containing about 10 to about 24 carbon atoms and $C_8$-$C_{18}$ alkyl sulfates and mixtures thereof.

The anionic surfactant may be any of the anionic surfactants known or previously used in the art of aqueous surfactant compositions. Suitable anionic surfactants include, but are not limited to, alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. Preferred are sodium salts of the surfactants. The alkyl groups generally contain about 8 to about 18 carbon atoms and may be unsaturated.

In certain embodiments, suitable anionic surfactants include sodium lauryl ether sulfate, ammonium lauryl ether sulfate, sodium lauryl sulfate, ammonium lauryl sulfate, triethanolamine lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, sodium cocoyl sarcosinate, triethanolamine monolauryl phosphate, and fatty acid soaps. Preferred are sodium lauryl ether sulfate, sodium lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, and sodium cocoyl sarcosinate.

In certain illustrative embodiments, examples of suitable sulfonated anionic surfactants include, but are not limited to, alkyl mononuclear aromatic sulfonates, such as the higher alkylbenzene sulfonates containing in one embodiment 8 to 18 carbon atoms, in another embodiment 11 to 16 carbon atoms, and in another embodiment 14 or 15 carbon atoms, the higher alkyl group in a straight or branched chain, or C8-15 alkyl toluene sulfonates and $C_8$-$C_{15}$ alkyl phenol sulfonates. In another embodiment, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Illustrative materials are described in U.S. Pat. No. 3,320,174. Of these, preferred are sodium salts of the anionic surfactants.

In another embodiment, examples of suitable sulfonated anionic surfactants include, but are not limited to, those surface-active or detergent compounds, which contain an organic hydrophobic group containing generally about 8 to about 26 carbon atoms or 10 to 18 carbon atoms in their molecular structure and at least one water-solubilizing group including, but not limited to, sulfonate, sulfate and carboxylate so as to form a water-soluble detergent. Usually, the hydrophobic group will include a $C_8$-$C_{22}$ alkyl, alkyl or acyl group. Such surfactants are employed in the form of water-soluble salts and the salt-forming cation is sodium, potassium, ammonium, magnesium and mono-, di- or tri-$C_2$-$C_3$ alkanolammonium. In an illustrative embodiment the cations are sodium, magnesium or ammonium cations, and preferred is sodium.

Other suitable anionic surfactants encompassed within the scope of the invention include, but are not limited to, the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, or 12 to 21 carbon atoms and having the formula $RCH{=}CHR_1$ where R is a higher alkyl group of 6 to 23 carbons and R1 is an alkyl group of 1 to 17 carbons or hydrogen to form a mixture of sulfones and alkene sulfonic acids which is then treated to convert the sulfones to sulfonates. In other embodiments olefin sulfonates contain about 14 to about 16 carbon atoms in the R alkyl group and are obtained by sulfonating an alpha-olefin.

Other examples of suitable anionic sulfonate surfactants encompassed within the scope of the invention include the paraffin sulfonates containing about 10 to about 20, or about 13 to about 17 carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

The compositions of the invention may also include alkyl ethoxylated ether sulfates or alkyl ether sulfates. Another surfactant utilized in the instant composition at a concentration of about 2 to about 15% by weight in one embodiment or about 4 to about 14% by weight in another embodiment is a metal salt of a $C_8$-$C_{18}$ alkyl ether sulfate. The alkyl ether sulfate (AEOS.xEO) is depicted by the Formula I:

$$R^1{-}(OCH(CH_3)CH_2)xOSO_3M \qquad \text{Formula I.}$$

In one embodiment, x is 1 to 22; in another embodiment x is 1 to 10. In certain embodiments, $R^1$ is an alkyl group having 10 to 16 carbon atoms; in other embodiments $R^1$ is an alkyl group having 12 to 15 carbon atoms. In other embodiments, $R^1$ is $C_{12}$-$C_{14}$, $C_{12}$-$C_{13}$ and $C_{12}$-$C_{15}$ and M is an alkali metal cation such as, for example, lithium, potassium, sodium or magnesium, preferably sodium.

Other examples of anionic ethoxylated sulfates are the $C_8$-$C_{18}$ alkyl ether sulfate salts having the Formula II:

$$R^1(OCH_2CH_2)nOSO_3M \qquad \text{Formula II}$$

wherein $R^1$ and M are defined above and n is 1 to 22, preferably 1 to 3.

In another embodiment, the anionic surfactant is present in an amount of about 3 wt. % to about 20 wt. %. In another embodiment, the anionic surfactant is present in an amount of about 5 wt. % to about 15 wt. %. In another embodiment, the anionic surfactant is present in an amount of about 8 wt. % to about 13 wt. %. In another embodiment, the anionic surfactant is present in an amount of about 12 wt. % to about 13 wt. %.

In certain embodiments, the compositions include a first surfactant and a second surfactant. In certain embodiments, the first anionic surfactant is present in an amount of about 8 wt. % to about 18 wt. % based on the weight of the total composition. In certain embodiments, the first anionic surfactant is present in an amount of about 8 wt. % to about 13 wt. % based on the weight of the total composition. In certain embodiments, the first anionic surfactant is present in an amount of about 8.5 wt. % based on the weight of the total composition. In certain embodiments, the first anionic surfactant is present in an amount of about 12.5 wt. % based on the weight of the total composition. In certain embodiments, the second anionic surfactant is present in an amount of about 5 wt. % to about 20 wt. % based on the weight of the total composition. In certain embodiments, the second anionic surfactant is present in an amount of about 13 wt. % to about 20 wt. % based on the weight of the total composition. In certain embodiments, the second anionic surfactant is present in an amount of about 13.5 wt. % based on the weight of the total composition. In certain embodiments, the second anionic surfactant is present in an amount of about 18 wt. % based on the weight of the total composition.

Zwitterionic Surfactants

The compositions of the invention also include one or more zwitterionic surfactants. In certain embodiment, the zwitterionic surfactant is also an amphoteric surfactant. Amphoteric and zwitterionic surfactants are those compounds that have the capacity of behaving either as an acid or a base. Suitable zwitterionic or amphoteric surfactants include, but are not limited to, alkyl betaines, alkyl amidopropyl betaines, alkyl sulphobetaines, alkyl glycinates, alkyl carboxyglycinates, alkyl amphopropionates, alkyl amidopropyl hydroxysultaines, acyl taurates and acyl glutamates wherein the alkyl and acyl groups have about 8 to about 18 carbon atoms. Examples include cocamidopropyl betaine, sodium cocoamphoacetate, cocamidopropyl hydroxysultaine, lauryl betaine, myristyl betaine, laurylamidopropyl betaine, myristamidopropyl betaine, and sodium cocamphopropionate.

In another embodiment, suitable zwitterionic surfactants for use herein contain both a cationic hydrophilic group (i.e., a quaternary ammonium group) and anionic hydrophilic group on the same molecule at a relatively wide range of pHs. The typical anionic hydrophilic groups are carboxylates and sulfonates, although other groups like sulfates, phosphonates, and the like can be used.

In certain embodiments, the zwitterionic surfactants also include hydrophobic groups including aliphatic or aromatic, saturated or unsaturated, substituted or unsubstituted hydrocarbon chains that can contain linking groups such as amido groups, ester groups. In another embodiment the hydrophobic group is an alkyl group containing about 1 to about 24 carbon atoms, in another embodiment about 8 to about 18, and in another embodiment about 10 to about 16. In certain embodiments, simple alkyl groups are utilized for cost and stability reasons.

Some common examples of betaine/sulphobetaine are described in U.S. Pat. Nos. 2,082,275, 2,702,279 and 2,255,082.

Examples of suitable alkyldimethyl betaines include, but are not limited, cocodimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamido-propyl betaine or $C_{10}$-$C_{14}$ fatty acylamidopropylene(hydropropylene)-sulfobetaine. For example $C_{10}$-$C_{14}$ fatty acylamidopropylene(hydropropylene)-sulfobetaine is commercially available from Sherex Company under the trade name "Varion CAS® sulfobetaine." A further example of betaine is Lauryl-imino-dipropionate. Laurylamido propylbetaine is commercially available from Stepan Chemical under tradename AmphoSol LB.

In certain embodiments, the zwitterionic surfactant is present in an amount of about 2 wt. % to about 7 wt. % based on the weight of the total composition. In certain embodiments, the zwitterionic surfactant is present in an amount of about 2.5 wt. % to about 6.5 wt. % based on the weight of the total composition. In certain embodiments, the zwitterionic surfactant is present in an amount of about 5.5 wt. % to about 6.5 wt. % based on the weight of the total composition.

The cleaning composition optionally Contains minor amounts, up to 3 wt. %, of other surfactants including nonionic surfactants. Suitable nonionic surfactants include alcohol ethoxylates, such as, the primary aliphatic alcohol ethoxylates, secondary aliphatic alcohol ethoxylates, and alkylphenol ethoxylates, and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups.

Acids of the Invention

The cleaning compositions of the invention also include an acid constituent, which can be a water soluble organic acid. The organic acids of the invention generally include at least one carbon atom, and include at least one carboxyl group (—COOH) in its structure. In certain embodiments, water soluble organic acids contain from 1 to about 6 carbon atoms and at least one carboxyl group.

In certain embodiments, organic acids include, but are not limited to, formic acid, citric acid, sorbic acid, acetic acid, glycolic acid, propanoic acid, propionic acid, oxalic acid, maleic acid, tartaric acid, adipic acid, lactic acid, malic acid, malonic acid, glycolic acid, and mixtures thereof. A preferred acid is lactic acid, for example, D- and/or L-lactic acid or mixtures thereof, and more preferred is L-lactic acid.

The compositions are acidic in nature (pH<7.0). Accordingly, there should be sufficient acid present in the composition such that the pH of the composition in various embodiments is less than about 6, or about 2 to about 5, or about 3 to about 4, or about 3.1 to about 3.5, or about 3.2 to about 3.3. The pH of the composition incorporating a selected acid is preferred to be within 10% of the pKa of the selected acid. Mixtures of two or more acids may be used, and the acid constituent may be present in any effective amount. The pH of the composition after the aging period remains less than about 6.5, or about 2.1 to about 5, or about 3 to about 4, or about 3.2 to about 3.8. The pH of the composition after the aging period incorporating a selected acid is preferred to be within 10% of the pKa of the selected acid. The aging period should be at least about two months, or about 6 months, or about 1 year or about 2 years.

The acid is present in an amount of less than about of 5% wt. based on the total weight of the compositions. In other embodiments, the acid is present in an amount of about 0.05 to about 4% wt., from about 1 to about 3% wt., and in an amount of about 2% wt. to about 2.5% wt. The amount of acid present after the aging period should not differ substantially from the level of acid in the initial composition.

Sequestering/Chelating Agents of the Invention

In certain embodiments, the cleaning compositions of the invention can also contain an organic or inorganic sequestrant or mixtures of sequestrants. Organic sequestrants such as citric acid, the alkali metal salts of nitrilotriacetic acid (NTA), EDTA or salts thereof, alkali metal gluconates, polyelectrolytes such as a polyacrylic acid, and the like can be used herein. In certain embodiments, sequestrants are organic sequestrants such as sodium gluconate due to the compatibility of the sequestrant with the formulation base.

The sequestering agent of the invention also includes an effective amount of a water-soluble organic phosphonic acid, which has sequestering properties. In certain embodiments, phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like.

The phosphonic acid may also include a low molecular weight phosphonopolycarboxylic acid such as one having about 2-4 carboxylic acid moieties and about 1-3 phosphonic acid groups. Such acids include 1-phosphono-1-methylsuccinic acid, phosphonosuccinic acid and 2-phosphonobutane-1,2,4-tricarboxylic acid.

Other organic phosphonic acids include 1-hydroxyethylidene-1,1-diphosphonic acid ($CH_3C(PO_3H_2)_2OH$), available from Monsanto Industrial Chemicals Co., St. Louis, Mo. as Dequest® 2010, a 58-62% aqueous solution; amino [tri (methylenephosphonic acid)]($N[CH_2PO_3H_2]_3$), available from Monsanto as Dequest® 2000, a 50% aqueous solution; ethylenediamine [tetra(methylene-phosphonic acid)] available from Monsanto as Dequest® 2041, a 90% solid acid product; and 2-phosphonobutane-1,2,4-tricarboxylic acid available from Mobay Chemical Corporation, Inorganic Chemicals Division, Pittsburgh, Pa. as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein. In certain embodiments, phosphonic acids useful in the present invention do not contain amino groups since they produce substantially less degradation of the active chlorine source than do phosphonic acids including amino groups.

Sequestrants of the invention also include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

In certain embodiments, sodium tripolyphosphate is an inorganic hardness sequestering agent for reasons of its ease of availability, low cost, and high cleaning power. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt-%) and its concentration must be increased using means other than solubility. Typical examples of such phosphates being alkaline condensed phosphates (i.e. polyphosphates) such as sodium or potassium pyrophosphate, sodium or potassium tripolyphosphate, sodium or potassium hexametaphosphate; carbonates such as sodium or potassium carbonate; borates, such as sodium borate.

If utilized, the sequestering or chelating agent(s) will generally include about 0.00015% to about 15% by weight of the cleaning compositions herein. In other various embodiments, if utilized, the sequestering or chelating agent(s) will include about 0.0003% to about 3.0% by weight of such compositions or about 0.003% to about 1.0% by weight of such compositions or about 0.03% to about 0.1% by weight of such compositions.

Fragrance Agents

The compositions and methods of the invention can also include one or more fragrance agents. Fragrance agents useful in the compositions and methods include a wide variety of natural and synthetic chemical ingredients, including, but not limited to, aldehydes, ketones, esters, and the like. Also included are various natural extracts and essences, which can include complex mixtures of ingredients, such as orange oil, lemon oil, rose extract, lavender, musk, patchouli, balsamic essence, sandalwood oil, pine oil, cedar, and the like. Finished fragrance agents can include extremely complex mixtures of such ingredients. Finished fragrance agents typically include about 0.01% to about 2%, by weight, of the detergent compositions herein, and individual fragrance agents can include about 0.0001% to about 90% of a finished perfume composition.

In a certain embodiments of the invention, the composition includes a blooming perfume. A blooming perfume ingredient is characterized by its boiling point (B.P.) and its octanol/water partition coefficient (P). The octanol/water partition coefficient of a perfume ingredient is the ratio between its equilibrium concentrations in octanol and in water. The fragrance agents of the invention have a B.P., determined at the normal, standard pressure of about 760 mm Hg, of about 260° C. or lower, less than about 255° C.; and less than about 250° C., and an octanol/water partition coefficient P of about 1,000 or higher. Since the partition coefficients of the fragrance agents of the invention have high values, they are more conveniently given in the form of their logarithm to the base 10, logP. Thus the fragrance agents have logP of about 3 or higher, or more than about 3.1, or more than about 3.2.

In certain embodiments, the compositions can include a combination of fragrance agents. In certain embodiments, the composition includes a first perfume ingredient having boiling point of 250° C. or less and ClogP of 3.0 or less; and a second perfume ingredient having boiling point of 250° C. or less and Clog P of 3.0 or more.

Hydrotropes

The compositions of the invention can also include one or more hydrotrope(s). Without being limited by theory it is believed that the hydrotrope contributes to the physical and chemical stability of the compositions.

Suitable hydrotropes include sulfonated hydrotropes. Any sulfonated hydrotropes known to those skilled in the art are suitable for use herein. In certain embodiments, alkyl aryl sulfonates or alkyl aryl sulfonic acids are used. In other embodiments alkyl aryl sulfonates include sodium, potassium, calcium and ammonium xylene sulfonates; sodium, potassium, calcium and ammonium toluene sulfonates; sodium, potassium, calcium and ammonium cumene sulfonates; sodium, potassium, calcium and ammonium substituted or unsubstituted naphthalene sulfonates and mixtures thereof, and preferred are sodium salts thereof. In other embodiments alkyl aryl sulfonic acids include xylenesulfonic acid, toluenesulfonic acid, cumenesulfonic acid, substituted or unsubstituted naphthalenesulfonic acid and salts thereof. In other embodiments, xylenesulfonic acid or p-toluene sulfonate or mixtures thereof are used.

In various embodiments, the compositions may include hydrotropes in amounts of about 0.01 wt. % to 20 wt. %, about wt. 0.05% to 10 wt. % or about 0.1 wt.% to 5 wt. % or about 3 wt. % by weight of the total composition.

Solvents of the Invention

The invention in certain embodiments can also include one or more solvents. Typical solvents used in the composition are aqueous soluble, miscible or immiscible. Solvents can include aliphatic and aromatic hydrocarbons, chlorinated hydrocarbons, alcohols, ether compounds, fluorocarbon compounds, and other similar low molecular weight generally volatile liquid materials. Of these, preferred are alkanols; more preferred are ethanol, isopropanol, and propanol; and most preferred is ethanol. In a particularly desirable embodiment, the solvents of the cleaning composition are of alkanols, and more preferably the solvent is ethanol. In various embodiments, the compositions may include solvents in amounts of up to about 6 wt. %, preferably at least about wt. 0.1% by weight of the total composition.

In certain embodiments, water is not a solvent but when used acts as a diluent or as a dispersing medium for the active materials. In other embodiments, water is a solvent.

These materials can be used in solution or as a miscible mixture or as a dispersion of the solvent in the aqueous liquid. A solvent or cosolvent can be used to enhance certain soil removal properties of this invention. Cosolvents include alcohols and the mono and di-alkyl ethers of alkylene glycols, dialkylene glycols, trialkylene glycols, etc. Alcohols which are useful as cosolvents in this invention include methanol, ethanol, propanol and isopropanol. Other suitable solvents include the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme. Nonaqueous liquid solvents can be used for varying compositions of the present invention. These include the higher glycols, polyglycols, polyoxides and glycol ethers.

Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), propylene glycol n-butyl ether, dipropylene glycol monobutyl ether, ethylene glycol n-butyl ether and ethylene glycol n-propyl ether, and combinations thereof. In certain embodiments, the glycol solvent is propylene glycol n-butyl ether. In certain embodiments, the glycol solvent is dipropylene glycol monobutyl ether.

Other useful solvents are ethylene oxide/propylene oxide, liquid random copolymer such as Synalox® solvent series from Dow Chemical (e.g., Synalox® 50-50B). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the trade name Dowanol®). Also tripropylene glycol mono methyl ether "Dowanol TPM®" from Dow Chemical is suitable.

The final ingredient in the inventive cleaning compositions is water. The proportion of water in the compositions generally is in the range of about 35% to about 90% or about 50% to 85% by weight of the cleaning composition.

Thickening Agents

In certain embodiments, the compositions of the invention also include a thickening or structuring agent. Suitable thickening or structuring agents may be organic or inorganic in nature. The agent may thicken the composition by either thickening the aqueous portions of the composition, or by thickening the non-aqueous portions of the composition. In certain embodiments, the agent is a water soluble polymer. In other embodiments, the agent is a cationic water soluble polymer.

In certain embodiments, the polymeric thickener may be added to the composition to achieve two objectives (i) to increase the "flow" viscosity or the yield stress, and (ii) to neutralize the anionic detergent carry-over guaranteeing a high level of softness in washing conditions where the carry-over is high. The flow viscosity corresponds to the viscosity measured with a flowmeter. The flowability of the tested composition is expressed as time needed to a fixed amount of product flowing through a small tube.

Thickeners can be divided into organic and inorganic thickeners. Of the organic thickeners there are (1) cellulosic thickeners and their derivatives, (2) natural gums, (3) acrylates, (4) starches, (5) stearates, (6) fatty acid alcohols and inorganic thickeners including (7) clays, and (8) salts. Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, gellan gum, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, tromethamine magnesium aluminum silicate, and the like. Some non-limiting examples of salts include calcium chloride, sodium chloride, sodium sulfate, ammonium chloride, and the like.

Some non-limiting examples of thickeners that thicken the non-aqueous portions of the composition include waxes such as candelilla wax, carnauba wax, beeswax, and the like, oils, vegetable oils and animal oils, and the like.

The composition may contain one thickener or a mixture of two or more thickeners. In certain embodiments the thickeners do not adversely react with the other components or compounds of the invention or otherwise render the composition of the invention ineffective. It is understood that a person skilled in the art will know how to select an appropriate thickener and control any adverse reactions through formulating.

The amount of thickener present in the composition depends on the desired viscosity of the composition. The composition may have a viscosity of about 100 to about 15,000 centipoise, of about 150 to about 10,000 centipoise, and of about 200 to about 5,000 centipoise as determined using a Brookfield DV-II+rotational viscometer using spindle #21 @ 20 rpm @ 70° F. Accordingly, to achieve the desired viscosities, the thickener may be present in the composition in an amount about 0.001 wt. % to about 5 wt. % of the total composition, about 0.01 wt. % to about 3 wt. %, and about 0.05 wt. % to about 2 wt. % of the total composition.

Thickeners from said classes of substance are commercially broadly available and are obtainable, for example, under the trade names Acusol® 820 (methacrylic acid (stearyl alcohol-20 EO) ester-acrylic acid copolymer, 30% strength in water, Rohm & Haas), Dapral®-GT-282-S (alkyl polyglycol ether, Akzo), Deuterol® polymer-11 (dicarboxylic acid copolymer, Schoner GmbH), Deuteron® XG (anionic heteropolysaccharide based on beta-D-glucose, D-manose, D-glucuronic acid, Schoner GmbH), Deuteron®-XN (nonionogenic polysaccharide, Schoner GmbH), Dicrylan® thickener-O (ethylene oxide adduct, 50% strength in water/isopropanol, Pfersse Chemie), EMA®-81 and EMA®-91 (ethylene-maleic anhydride copolymer, Monsanto), thickener-QR-100 (polyurethane emulsion, 19 21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell) and Shellflo®-XA (xanthan biopolymer, stabilized with formaldehyde, Shell).

The inventors have discovered that xanthan gum is useful as a thickening agent for suspending fragrance molecules in a hard surface cleaner. In certain embodiments, the thickening agent is xanthan gum. In other embodiments, the thickening agent is xanthan gum present in at least about 0.2 weight %.

Additional Optional Ingredients

Examples of additional optional components include, but are not limited to, hydrotropes, fluorescent whitening agents, photobleaches, fiber lubricants, reducing agents, enzymes, enzyme stabilizing agents, powder finishing agents, builders, bleaches, bleach catalysts, soil release agents, dye transfer inhibitors, buffers, colorants, fragrances, pro-fragrances, rheology modifiers, anti-ashing polymers, soil repellents, water-resistance agents, suspending agents, aesthetic agents, structuring agents, sanitizers, solvents, fabric finishing agents, dye fixatives, fabric conditioning agents and deodorizers.

Other surfactants which can be utilized in the present invention are set forth in more detail in WO 99/21530, U.S. Pat. No. 3,929,678; U.S. Pat. No. 4,565,647; U.S. Pat. No. 5,720,964; and U.S. Pat. No. 5,858,948. Other suitable surfactants are described in McCutcheon's Emulsifiers and Detergents (North American and International Editions, by Schwartz, Perry and Berch), which is hereby fully incorporated by reference.

In addition to the previously mentioned constituents of the composition, one may also employ normal and conventional adjuvants, provided they do not adversely affect the properties of the detergent. Thus there may be used a cationic antibacterial agent, coloring agents and perfumes; polyethylene glycol, ultraviolet light absorbers such as the Uvinuls, which are products of GAF Corporation; pH modifiers; etc. The proportion of such adjuvant materials, in total will normally not exceed 15% by weight of the detergent composition, and the percentages of illustrative examples of such individual components will be about 5% by weight. Sodium formate or formalin or Quatemium 15 (Dowicil 75) can be included in the formula as a preservative at a concentration of about 0.1 to about 4.0 wt. %.

Process of Manufacture

The compositions are readily made by simple mixing methods from readily available components which, on storage, do not adversely affect the entire composition. If a structuring agent is incorporated in the compositions, a homogenization process can be added in the production method. Solubilizing agent such as ethanol, hexylene glycol, sodium chloride and/or sodium xylene or sodium xylene sulfonate are used to assist in solubilizing the surfactants. The viscosity of the light duty liquid composition desirably will be at least 100 centipoises (cps) at room temperature, but may be up to 1,000 centipoises. The viscosity of the light duty liquid composition and the light duty liquid composition itself remain stable on storage for lengthy periods of time, without color changes or settling out of any insoluble materials.

Methods of Use

The invention encompasses cleaning compositions useful for cleaning a surface. The compositions surprisingly possess antibacterial efficacy and low toxicity.

By surfaces, it is meant herein any kind of surfaces typically found in houses like kitchens, bathrooms, or the exterior surfaces of a vehicle, for example, floors, walls, tiles, windows, sinks, showers, shower plastified curtains, wash basins, WCs, dishes and other food contact surfaces, fixtures and fittings and the like made of different materials like ceramic, vinyl, no-wax vinyl, linoleum, melamine, glass, any plastics, plastified wood, metal, especially steel and chrome metal or any painted or varnished or sealed surface and the like. Surfaces also include household appliances including, but not limited to, refrigerators, garbage cans, freezers, washing machines, automatic dryers, ovens, microwave ovens, dishwashers and so on. The present composition is especially efficacious in the cleaning of ceramic, steel, plastic, glass and the exterior painted or otherwise finished surface of a vehicle, for example, a car. The cleaning compositions are also safe on the skin.

The cleaning composition is applied to the surface, undiluted or diluted, optionally after a pre-rinse step. The cleaning composition can be diluted with water, preferably up to a dilution ratio of 1:20, without significantly affecting its cleaning and antimicrobial efficacies. The composition can be applied using a cloth or sponge onto which the composition has been applied or by pouring the composition over the surface. Alternatively the composition may be applied by spraying the composition onto the surface using a spraying device as described above. The cleaning compositions of the invention can be left to sit on a surface or be wiped or scrubbed on or from the surface.

Once the composition has been applied to the surface, the surface can then be optionally rinsed, usually with water, and left to dry naturally. Optionally the user can wait in between application of the composition and rinsing in order to allow the composition maximum working time. A particular benefit of the composition is that the surface can be cleaned as described above with minimal rinsing and the surface left to dry naturally without accumulating physiologically harmful deposits, and/or with reduced or no corrosion.

The following examples illustrate compositions of the invention. Unless otherwise specified, all percentages are by weight. The exemplified compositions are illustrative only and do not limit the scope of the invention. Unless otherwise specified, the proportions in the examples and elsewhere in the specification are by active weight. The active weight of a material is the weight of the material itself excluding water or other materials that may be present in the supplied form of the material.

EXAMPLES

The following examples illustrate liquid cleaning compositions of the invention. Unless otherwise specified, all percentages are by weight. The exemplified compositions are illustrative only and do no limit the scope of the invention. It will be understood by those of skill in the art that numerous and various modifications can be made without departing from the spirit of the present invention. Therefore, it should be clearly understood that the forms of the present invention described herein are illustrative only and are not intended to limit the scope of the invention.

Example 1

Tables 1a-1d illustrate several non-limiting illustrative embodiments of the invention illustrating regular and ultra dishwashing liquids.

TABLE 1a

| Ingredient | Reg 2a (wt. %) | Reg 2b (wt. %) | Reg 1a (wt. %) | Reg 1b (wt. %) | Ultra 2a (wt. %) | Ultra 2b (wt. %) | Ultra 1a (wt. %) | Ultra 1b (wt. %) |
|---|---|---|---|---|---|---|---|---|
| Na DBS[1] | 3.7 | 3.7 | 8.4 | 8.4 | 5.8 | 5.8 | 8.5 | 8.5 |
| SLES (2EO) $C_{12}$-$C_{14}$ | 12 | 12 | 9.2 | 9.2 | 19.6 | 19.6 | 17.9 | 17.9 |
| Laurylamidopropyl betaine | 3.4 | 3.4 | 1.5 | 1.5 | 6.6 | 6.6 | 5.4 | 5.4 |
| Ethanol | 3.5 | 3.5 | 2.1 | 2.1 | 6 | 6 | 4.3 | 4.3 |
| Lactic Acid | 2 | 2 | 2 | 2 | 2 | 2 | 2 | 2 |
| $Mg_2SO_4$ | 0 | 0 | 3.5 | 3.5 | 0 | 0 | 0.9 | 0.9 |
| SXS | 0.8 | 0.8 | 0.8 | 0.8 | 2.2 | 2.2 | 3 | 3 |
| NaCl | 0 | 0 | 0.7 | 0.7 | 0 | 0 | 0 | 0 |
| $Na_4EDTA$ | 0.1 | 0.1 | 0.1 | 0.1 | 0.1 | 0.1 | 0.1 | 0.1 |
| Color solution | 0.2 | 0.2 | 0.2 | 0.2 | 0.2 | 0.2 | 0.2 | 0.2 |
| Fragrance option A | 0.26 | 0 | 0.26 | 0 | 0.4 | 0 | 0.4 | 0 |
| Fragrance option B | 0 | 0.26 | 0 | 0.26 | 0 | 0.45 | 0 | 0.45 |
| Water | qs | qs | qs | qs | qs | qs | qs | qs |
| Total Surfactant % | 19 | 19 | 19 | 19 | 32 | 32 | 32 | 32 |
| Calculated $LD_{50}$ | 4100 | 4100 | 3895 | 3895 | 4157 | 4157 | 3721 | 3721 |

[1]Sodium dodecyl benzene sulfonate

TABLE 1b

| Ingredient | Reg. 1c | Reg. 2c | Ultra 1c | Ultra 2c |
|---|---|---|---|---|
| NaLAS | 8.4 | 3.7 | 8.5 | 5.75 |
| SLES | 9.3 | 12.1 | 17.9 | 19.6 |
| Betaine | 1.5 | 3.4 | 5.4 | 6.6 |
| Lactic | 2 | 2 | 2 | 2 |

TABLE 1c

| Ingredient | Reg. 1d | Reg. 2d |
|---|---|---|
| NaLAS | 5.3 | 2.3 |
| SLES | 5.8 | 7.6 |
| Betaine | 0.1 | 2.2 |
| Lactic | 2 | 2 |

TABLE 1d

| Ingredient | (wt. %) |
|---|---|
| Na DBS[1] | 12.7 |
| SLES (2EO) $C_{12}$-$C_{14}$ | 13.7 |
| Laurylamido propyl Betaine | 5.6 |
| Ethanol | 4 |
| Lactic Acid | 2 |
| SXS | 2.5 |
| Color Solution | 0.3 |
| Fragrance | 0.35 |
| Water | Qs |

Example 2

Tables 2a-2d illustrate several non-limiting illustrative embodiments of the invention. Amounts added are based on the percent raw amount of ingredient added.

In certain illustrative embodiments of the invention, the EPA mandated antibacterial efficacy of the cleaning compositions has been validated for independent lots of dish liquid manufactured under GMP conditions. The lots were tested on 10 carriers (replicate surfaces) against *Staphylycoccus aureus* ATCC 6538 and, separately on 10 carriers (replicate surfaces) against *Salmonella enterica* ATCC 10708 as mandated by the EPA. A confirmatory test, on independent lots, was also tested on 10 carriers (replicate surfaces) against *Escherichia coli* O157 H7 ATCC 43895 for additional on-pack claims against this specific and relevant food pathogen. The tests were conducted on 1:20 use-dilutions with a 30-second exposure time. In all cases a minimum 3-log reduction or 99.9% kill rate was attained for both the surfaces and the run-off counts, as prescribed for EPA acceptance.

TABLE 2a

| Organism | Lot Number | Dilution | Replicate | CFU/carrier | Average $\log_{10}$ reduction |
|---|---|---|---|---|---|
| *S. aureus* | 1a | 1:20 | 1 | $5.4 \times 10^2$ | 3.41 |
| | | | 2 | $1.8 \times 10^2$ | 3.89 |
| | | | 3 | $3.0 \times 10^1$ | 4.67 |
| | | 1:50 | 1 | $8.0 \times 10^1$ | 4.54 |
| | | | 2 | $3.7 \times 10^2$ | 3.58 |
| | | | 3 | $1.9 \times 10^2$ | 4.15 |
| | 2a | 1:20 | 1 | $4.7 \times 10^2$ | 3.47 |
| | | | 2 | $5.9 \times 10^2$ | 3.38 |
| | | | 3 | $7.3 \times 10^2$ | 3.28 |

TABLE 2a-continued

| Organism | Lot Number | Dilution | Replicate | CFU/carrier | Average $\log_{10}$ reduction |
|---|---|---|---|---|---|
| | | 1:50 | 1 | $8.8 \times 10^2$ | 3.20 |
| | | | 2 | $6.1 \times 10^2$ | 3.36 |
| | | | 3 | $5.5 \times 10^2$ | 3.41 |
| | 3a | 1:20 | 1 | $1.0 \times 10^1$ | 5.51 |
| | | | 2 | $5.0 \times 10^1$ | 4.45 |
| | | | 3 | $2.0 \times 10^1$ | 4.85 |
| | | 1:50 | 1 | $1.0 \times 10^1$ | 5.51 |
| | | | 2 | $5.0 \times 10^1$ | 4.45 |
| | | | 3 | $5.0 \times 10^1$ | 4.45 |
| | 4a | 1:20 | 1 | $3.4 \times 10^2$ | 3.61 |
| | | | 2 | $3.6 \times 10^2$ | 3.59 |
| | | | 3 | $1.2 \times 10^2$ | 4.07 |
| | | 1:50 | 1 | $5.1 \times 10^2$ | 3.44 |
| | | | 2 | $3.0 \times 10^2$ | 3.67 |
| | | | 3 | $2.4 \times 10^2$ | 3.77 |

TABLE 2b

| Organism | Lot Number | Dilution | Replicate | CFU/carrier | Average $\log_{10}$ reduction |
|---|---|---|---|---|---|
| *S. aureus* | 1b | 1:20 | 1 | $4.5 \times 10^2$ | 3.99 |
| | | | 2 | $4.7 \times 10^2$ | 3.97 |
| | | | 3 | $3.7 \times 10^2$ | 4.08 |
| | | 1:50 | 1 | $9.3 \times 10^2$ | 3.67 |
| | | | 2 | $8.1 \times 10^2$ | 3.73 |
| | | | 3 | $7.6 \times 10^2$ | 3.76 |
| | 2b | 1:20 | 1 | $1.5 \times 10^3$ | 3.47 |
| | | | 2 | $1.1 \times 10^3$ | 3.60 |
| | | | 3 | $1.4 \times 10^3$ | 3.50 |
| | | 1:50 | 1 | $1.7 \times 10^3$ | 3.41 |
| | | | 2 | $2.4 \times 10^3$ | 3.26 |
| | | | 3 | $2.1 \times 10^3$ | 3.32 |
| | 3b | 1:20 | 1 | $1.2 \times 10^2$ | 4.56 |
| | | | 2 | $1.1 \times 10^2$ | 4.60 |
| | | | 3 | $4.2 \times 10^2$ | 4.02 |
| | | 1:50 | 1 | $5.0 \times 10^1$ | 4.94 |
| | | | 2 | $9.0 \times 10^1$ | 4.69 |
| | | | 3 | $7.0 \times 10^1$ | 4.80 |
| | 4b | 1:20 | 1 | $3.2 \times 10^2$ | 4.14 |
| | | | 2 | $4.9 \times 10^2$ | 3.95 |
| | | | 3 | $4.4 \times 10^2$ | 4.00 |
| | | 1:50 | 1 | $1.1 \times 10^3$ | 3.60 |
| | | | 2 | $1.5 \times 10^3$ | 3.47 |
| | | | 3 | $6.7 \times 10^2$ | 3.82 |

TABLE 2c

| Organism | Lot Number | Dilution | Replicate | CFU/carrier | Average $\log_{10}$ reduction |
|---|---|---|---|---|---|
| *E. coli* | 1c | 1:20 | 1 | $1.9 \times 10^2$ | 4.17 |
| | | | 2 | $2.5 \times 10^2$ | 4.04 |
| | | | 3 | $8.3 \times 10^2$ | 3.53 |
| | | 1:50 | 1 | $3.3 \times 10^2$ | 3.93 |
| | | | 2 | $2.0 \times 10^2$ | 4.15 |
| | | | 3 | $1.5 \times 10^2$ | 4.27 |
| | 2c | 1:20 | 1 | $6.3 \times 10^2$ | 3.65 |
| | | | 2 | $5.0 \times 10^2$ | 3.75 |
| | | | 3 | $5.1 \times 10^2$ | 3.74 |
| | | 1:50 | 1 | $1.6 \times 10^2$ | 4.24 |
| | | | 2 | $2.2 \times 10^2$ | 4.10 |
| | | | 3 | $3.0 \times 10^1$ | 4.97 |
| | 3c | 1:20 | 1 | $6.2 \times 10^4$ | 1.65 |
| | | | 2 | $6.6 \times 10^3$ | 2.63 |
| | | | 3 | $6.0 \times 10^4$ | 1.67 |

TABLE 2c-continued

| Organism | Lot Number | Dilution | Replicate | CFU/carrier | Average $\log_{10}$ reduction |
|---|---|---|---|---|---|
| | | 1:50 | 1 | $6.3 \times 10^4$ | 1.65 |
| | | | 2 | $6.8 \times 10^3$ | 2.61 |
| | | | 3 | $6.2 \times 10^3$ | 2.65 |
| | 3d | 1:20 | 1 | $4.0 \times 10^2$ | 3.85 |
| | | | 2 | $7.3 \times 10^2$ | 3.58 |
| | | | 3 | $1.4 \times 10^2$ | 4.30 |
| | | 1:50 | 1 | $2.0 \times 10^1$ | 5.15 |
| | | | 2 | $2.0 \times 10^1$ | 5.15 |
| | | | 3 | $2.8 \times 10^2$ | 4.00 |

TABLE 2d

| Organism | Lot Number | Dilution | Replicate | CFU/carrier | Average $\log_{10}$ reduction |
|---|---|---|---|---|---|
| *E. coli* | 1d | 1:20 | 1 | $9.0 \times 10^1$ | 4.74 |
| | | | 2 | $<1.0 \times 10^1$ | >5.70 |
| | | | 3 | $<1.0 \times 10^1$ | >5.70 |
| | | 1:50 | 1 | $6.0 \times 10^2$ | 3.92 |
| | | | 2 | $4.4 \times 10^2$ | 4.06 |
| | | | 3 | $2.4 \times 10^2$ | 4.32 |
| | 2d | 1:20 | 1 | $1.0 \times 10^1$ | 5.70 |
| | | | 2 | $<1.0 \times 10^1$ | >5.70 |
| | | | 3 | $4.0 \times 10^2$ | 4.10 |
| | | 1:50 | 1 | $7.0 \times 10^1$ | 4.85 |
| | | | 2 | $5.0 \times 10^1$ | 5.00 |
| | | | 3 | $2.6 \times 10^2$ | 4.28 |
| | 3d | 1:20 | 1 | $1.8 \times 10^4$ | 2.44 |
| | | | 2 | $4.4 \times 10^3$ | 3.06 |
| | | | 3 | $1.1 \times 10^4$ | 2.66 |
| | | 1:50 | 1 | $4.2 \times 10^3$ | 3.08 |
| | | | 2 | $1.7 \times 10^3$ | 3.47 |
| | | | 3 | $1.7 \times 10^4$ | 2.47 |
| | 4d | 1:20 | 1 | $2.0 \times 10^1$ | 5.40 |
| | | | 2 | $9.0 \times 10^1$ | 4.74 |
| | | | 3 | $2.0 \times 10^1$ | 5.40 |
| | | 1:50 | 1 | $1.0 \times 10^2$ | 4.70 |
| | | | 2 | $<1.0 \times 10^1$ | >5.70 |
| | | | 3 | $3.8 \times 10^2$ | 4.12 |

Example 3

In certain embodiments, the cleaning compositions of the invention include inert ingredients. The inert ingredients include the surfactants that provide surface cleaning benefits, viscosity modifiers, salts, hydrotropes, chelants that deliver conventional and consumer parameters such as dispensing and clarity, and color/fragrance to provide a consumer-delightful product use experience. The inerts are shown in Table 3 with its status on the EPA Inert List.

TABLE 3

| Ingredient | EPA Inert List |
|---|---|
| Na DBS[1] | 3 |
| SLES (2EO) $C_{12}$-$C_{14}$ | 4B |
| Laurylamidopropyl Betaine | 3 |
| Ethanol | 4B |
| Lactic Acid | 4B |
| $Mg_2SO_4$ | 4A |
| SXS | 3 |
| NaCl | 4A |
| $Na_4EDTA$ | 4B |
| Gellan gum | 4A |
| Water | n/a |

[1]Sodium dodecyl benzene sulfonate

Example 4

The cleaning compositions of the invention were designed for minimal corrosivity for processing equipment. In Tables 4a, 4b and 4c, high salt, Sample 1, and low salt, Sample 2, versions of formulas were tested by both short-term, accelerated electrochemical polarization tests at 100° F., and longer-term (6 weeks) immersion tests at 100° F. and at 140° F. with creviced-corrosion coupons made of varying grades of stainless steel.

TABLE 4a

| | Ingredient % Weight in Formulation | | | |
|---|---|---|---|---|
| Ingredient | Sample 1 | Sample 2 | Surfactant Control | 3% NaCl solution |
| Na DBS[1] | 8.5 | 8.5 | 8.2 | 0 |
| SLES (2EO) $C_{12}$-$C_{14}$ | 17.9 | 17.9 | 0 | 0 |
| $NH_4$ AEOS (1.3 EO) | 0 | 0 | 11.3 | 0 |
| Laurylamidopropyl betaine | 5.4 | 5.4 | 0 | 0 |
| Amine Oxide | 0 | 0 | 3.5 | 0 |
| Lactic Acid | 2.0 | 2.0 | 0 | 0 |
| $MgSO_4$ | 0.9 | 0.9 | 1.31 | 0 |
| Alcohol | 3.0 | 4.3 | 1.4 | 0 |
| NaCl (added) | 3.3 | 0 | 0.8 | 3.0 |
| SXS | 3.0 | 3.0 | 0.65 | 0 |
| Chealant | 0.1 | 0.1 | 0.1 | 0 |
| Color Solution | 0.2 | 0.2 | 0.1 | 0 |
| Fragrance A | 0.4 | 0.4 | 0 | 0 |
| Fragrance B | 0 | 0 | 0.3 | 0 |

[1]Sodium dodecyl benzene sulfonate

TABLE 4b

| Formula Description | pH | Cond.[1] (1st) | Cond. (2nd) | Cl— (ppm) | $SO_4$— (ppm) | AcO— (ppm) | LPR 1 (mpy) | LPR 2 (mpy) |
|---|---|---|---|---|---|---|---|---|
| Sample 1 | 3.04 | 39.3 mS | 41.7 mS | 23.980 | 7.999 | 14.138 | 0.248 | 0.223 |
| Sample 2 | 2.89 | 25.6 mS | 25.4 mS | 6.190 | 10.496 | 15.726 | 0.081 | 0.068 |
| Surfactant Control | 6.60 | 28.2 mS | 28.5 mS | 4.494 | 11.648 | BDL | 0.059 | 0.050 |
| 3% NaCl Solution | 3.00 | | 40.6 mS | | | | 0.083 | 0.122 |

[1]A first conductivity reading was taken and then a second conductivity reading was taken.

Electrochemical testing was done at 40° C.

TABLE 4c

| Alloy Formula | 40° C. Surfactant Control | 40° C. Sample 2 | 40° C. Sample 1 | 60° C. Surfactant Control | 60° C. Sample 2 | 60° C. Sample 1 |
|---|---|---|---|---|---|---|
| Attribute Description | High pH Low Cl— | Low pH Low Cl— | Low pH High Cl— | High pH Low Cl— | Low pH Low Cl— | Low pH High Cl— |
| pH | 6.6 | 3.0 | 3.0 | 6.6 | 3.0 | 3.0 |
| Chloride (ppm) | 4500 | 6200 | 24000 | 4500 | 6200 | 24000 |
| Stainless Steel[1] | No Attack | No Attack | Crevice Attack | No Attack | Crevice Attack | Crevice Attack |
| Stainless Steel | Not Tested | Not Tested | Not Tested | No Attack | No Attack | Crevice Attack |

[1]2 Types of Stainless steel were tested (316L and AL6XN)

Example 5

The cleaning compositions of the invention provide competitive foaming/cleaning performance with existing commercial products. Traditional performance tests were completed to assess the flash foam profile with and without soil (shake-foam), the foam mileage (miniplate), and typical/dynamic (Baumgartner) grease soil removal for both the ultra and regular density dishliquids. The resulting performance profiles against in-market products are shown in the tables below. These results indicate an unexpectedly higher performance profile that should be more acceptable to the consumer.

(1) Baumgartner Grease Removal

The Baumgartner test measures grease removal in every day cleaning situations. Plastic tubes covered with solidified lard, tallow, or mixed greasy soil are dipped in a warm LDL solution 100 times; the concentration of the solution is 0.0667%. The total dipping time is approximately 1 minute. The tubes are weighed before and after grease is applied. After the tubes dry, the % grease removal is calculated.

(2) Shake-Foam Test 100 ml of a diluted (0.033%) test solution in 150 ppm hardness water at RT is filled into a 500 ml graduated cylinder with a stopper. The stoppered cylinder is placed on an agitating machine, which rotates the cylinder for 40 cycles at 30 rpm. The height of the foam in the cylinder is observed. A milk soil is then introduced (about 175 μL) into the cylinder. The cylinder is then inserted 40 times more, and the height after soil addition is recorded.

The number of miniplates is measured using an automated miniplate test. The procedure is described in detail in U.S. Pat. No. 4,556,509, which is incorporated herein by reference. The test is used to determine the number of theoretical plates that can be washed in a cleaning solution until the foam disappears. This test is used to demonstrate the improvement in cleaning efficiency as gauged by foam volume and foam stability. Foam is generated in a detergent solution by the action of an agitating brush. The foam is electronically measured by reflectance of the solution surface (with an added dye) as a mixed soil (potato, milk, olive oil, crisco) is added to the detergent solution at a steady rate. The disappearance of the foam determines the endpoint of the test and the number of miniplates is then calculated based on foam duration and the rate of soil addition. For these, tests the detergent solution was an illustrative cleaning composition of the invention at 3.3 wt. % with 150 ppm Mg/$CaCO_3$ hardness and was initially heated to 47° C. at the start of soil addition.

TABLE 5a

| Ingredient | Ingredient % Weight in Formulation: Sample 1 | Sample 2 | Sample 3 | Sample 4 | In-market Control |
|---|---|---|---|---|---|
| Na DBS[1] | 8.4 | 4 | 4 | 4 | 0 |
| Mg DBS[2] | 0 | 0 | 0 | 0 | 12.2 |
| SLES (2EO) $C_{12}$-$C_{14}$ | 9.3 | 13 | 13 | 13 | 0 |
| $NH_4$ AEOS (1.3 EO) | 0 | 0 | 0 | 0 | 7 |
| Laurylamidopropyl betaine | 1.5 | 3.7 | 3.7 | 3.7 | 0 |
| Amine Oxide | 0 | 0 | 0 | 0 | 1 |
| $MgSO_4$ | 0.9 | 0.9 | 0 | 0 | 0.5 |
| NaCl (added) | 1.85 | 3.25 | 2.5 | 0 | 0 |
| Antibacterial | Lactic acid | Lactic acid | Lactic acid | Lactic acid | Triclosan |
| Total % Surfactant | 19.2 | 20.7 | 20.7 | 20.7 | 20.2 |

[1]Sodium dodecyl benzene sulfonate

[2]Magnesium dodecyl benzene sulfonate

TABLE 5b

| Sample | Total % Surfactant | Baumgartner | SFI Mean | SFS Mean | Miniplate |
|---|---|---|---|---|---|
| 1 | 19.2% | 75.83 | 391.67 | 128.33 | 14 |
| 2 | 20.7% | 81.13 | 391.67 | 130.00 | 20 |
| 3 | 20.7% | 76.17 | 391.67 | 136.37 | 19.5 |
| 4 | 20.7% | 80.27 | 408.33 | 138.33 | 23 |
| In-market Control | 20.2% | 88.32 | 383.33 | 123.33 | 17 |

TABLE 5c

| Ingredient | Ingredient % Weight in Formulation: Sample 1 | Sample 2 | Sample 3 | Sample 4 | In-market Control |
|---|---|---|---|---|---|
| Na DBS[1] | 5.7 | 5.7 | 8.5 | 8.5 | 0.9 |
| Mg DBS[2] | 0 | 0 | 0 | 0 | 13.1 |
| SLES (2EO) $C_{12}$-$C_{14}$ | 18.9 | 18.9 | 17.9 | 17.9 | 0 |
| $NH_4$ AEOS (1.3 EO) | 0 | 0 | 0 | 0 | 16.2 |
| Laurylamidopropyl betaine | 5.4 | 5.4 | 5.4 | 5.4 | 0 |
| Amine Oxide | 0 | 0 | 0 | 0 | 5.9 |

TABLE 5c-continued

| Ingredient | Ingredient % Weight in Formulation | | | | |
|---|---|---|---|---|---|
| | Sample 1 | Sample 2 | Sample 3 | Sample 4 | In-market Control |
| $MgSO_4$ | 0 | 0 | 0.85 | 0.85 | 0 |
| NaCl (added) | 3.5 | 0 | 3.0 | 0 | 0.4 |
| Antibacterial | Lactic acid | Lactic acid | Lactic acid | Lactic acid | Triclosan |
| Total % Surfactant | 30 | 30 | 31.8 | 31.8 | 35.6 |

[1]Sodium dodecyl benzene sulfonate
[2]Magnesium dodecyl benzene sulfonate

TABLE 5d

| Sample | Total % Surfactant | Baumgartner | SFI Mean | SFS Mean | Miniplate |
|---|---|---|---|---|---|
| 1 | 30% | 68.267 | 390 | 141.67 | 20.4 |
| 2 | 30% | 67.75 | 398.33 | 146.67 | 19 |
| 3 | 31.8% | 71.12 | 403.33 | 145.00 | 21.4 |
| 4 | 31.8% | 75.85 | 395.67 | 163.33 | 21.4 |
| In-Market Control | 35.6% | 84.03 | 380 | 161.67 | 23.4 |

Example 6

The cleaning compositions of the invention provide superior rinsing and/or shine performance with existing products. Studies showed that the acidic formula can deliver advantages on rinsing attributes versus in-market formulas. This is likely to be especially noticeable in hard water environments.

The rinsing benefits of the compositions of the invention were demonstrated by actual in lab rinsing measurements. This method involves applying an illustrative cleaning composition of the invention to a plate and recording the time it takes for full rinsing of the product. The illustrative cleaning compositions of the invention were nearly twice as fast to rinse.

TABLE 6

| | Composition of the Invention | Control |
|---|---|---|
| Rinsing Time | 6.5 sec | 11.8 sec |

Example 7

Tables 7a-7e illustrate properties including good Foam Volume, good Grease Redeposition, and good rinsibility of illustrative embodiments of the invention.

TABLE 7a

| Ingredient | Sample 1 | Sample 2 | Sample 3 | Sample 4 In-market Control |
|---|---|---|---|---|
| Na DBS[1] | 10 | 10 | 6.4 | 0 |
| Mg DBS[2] | 0 | 0 | 0 | 14 |
| SLES (2EO) $C_{12}$-$C_{14}$ | 21 | 21 | 24.6 | 0 |
| $NH_4$ AEOS (1.3 EO) | 0 | 0 | 0 | 16.1 |
| Laurylamidopropyl betaine | 3.6 | 3.6 | 3.6 | 0 |
| Amine Oxide | 0 | 0 | 0 | 5.9 |
| $MgSO_4$ | 0 | 1.7 | 1.6 | 0 |

TABLE 7a-continued

| Ingredient | Sample 1 | Sample 2 | Sample 3 | Sample 4 In-market Control |
|---|---|---|---|---|
| NaCl (added) | 0 | 0.25 | 1.3 | 0.4 |
| Antibacterial | Lactic acid | Lactic acid | Lactic acid | Triclosan |
| Total % Surfactant | 34.7 | 34.6 | 34.6 | 36 |

[1]Sodium dodecyl benzene sulfonate
[2]Magnesium dodecyl benzene sulfonate

TABLE 7b

| Product | ini | soil | re-en | Neat[1] Foam1 | Neat[2] Foam2 |
|---|---|---|---|---|---|
| | 0.42[3] | 0.55 | 0.51 | 0.70 | 0.73 |
| Sample 1 | 6.5[4] | 4.0 | 4.1 | 7.4 | 3.7 |
| Sample 2 | 6.7 | 4.5 | 4.7 | 7.0 | 3.6 |
| Sample 3 | 6.6 | 4.5 | 4.7 | 7.1 | 3.6 |
| Sample 4 | 6.7 | 4.5 | 4.8 | 5.7 | 2.6 |

[1]Neat foam without soils - 15 squeezes.
[2]Neat foam with soils added - 10 additional squeezes.
[3]Minimum significant difference.
[4]Means having the same letter are not significantly different (alpha = 0.10).

TABLE 7c

| Product | Gr on glass | Gr on plate | Gr on plastic | Gr on knife | tub |
|---|---|---|---|---|---|
| | 0.32 | 0.17 | 0.29 | 0.22 | 0.40 |
| Sample 1 | 1.1 | 0.3 | 0.8 | 0.4 | 1.7 |
| Sample 2 | 0.9 | 0.3 | 0.8 | 0.5 | 1.3 |
| Sample 3 | 0.9 | 0.4 | 0.8 | 0.4 | 1.4 |
| Sample 4 | 0.7 | 0.2 | 0.6 | 0.3 | 1.0 |

TABLE 7d

| Product | DLRIN (Ease of rinse)[1] Glass | Ease of Rinse Plate (sec)[2] | Amount of water film (%)[3] | Neat[4] Glass | Neat[4] Plate |
|---|---|---|---|---|---|
| | 0.49[5] | 1.04 | 10.73 | 0.74 | 0.70 |
| Sample 1 | 6.2[6] | 8.3 | 46.9 | 1.9 | 1.2 |
| Sample 2 | 6.2 | 10.0 | 42.4 | 2.1 | 1.9 |
| Sample 3 | 6.3 | 9.7 | 50.2 | 2.6 | 1.7 |
| Sample 4 | 6.8 | 13.0 | 48.0 | 2.6 | 1.8 |

[1]Number of rinses till no foam.
[2]Seconds needed to rinse detergent off plate.
[3]Percent water film on plate.
[4]Detergent residue remaining on dishes.
[5]Minimum significant difference.
[6]Means having the same letter are not significantly different (alpha = 0.10).

TABLE 7e

| Product | Fat soils remaining |
|---|---|
| Sample 1 | 2.4 |
| Sample 2 | 2.5 |
| Sample 3 | 2.3 |
| Sample 4 | 1.58 |

Example 8

The compositions exhibit stability at reduced and increased temperatures. More specifically, such compositions remain clear and stable in the range of about 0° C. to about 50° C.

Creep Yield Stress Test (static test)—This rheological test was conducted on the TA Instruments ARG2 rheometer. It uses the high surface area vane geometry that is very sensitive and can measure very low yield stresses. The test is run in a 50-gram water-jacketed sample holder at a constant temperature of 25° C. The test runs a creep test (strain vs. stress) at stresses ranging from 0.01 Pa to 0.6 Pa. Custom software then calculates yield stress from the family of curves generated for each sample. A yield stress above 0.5 dyn/cm$^2$ is ideal for supporting particulates, but a yield stress above 0.15 dyn/cm$^2$ is sufficient to justify product positioning as a gel or dish gel.

Brookfield Yield Stress Test (dynamic test)—This test was developed to approximate the creep analysis above, but with much more rapid output to provide rapid feedback when processing formulas at manufacturing conditions. It also uses the high surface area vane geometry that is very sensitive and can measure very low yield stresses. The test is run in a 400-milliliter glass beaker. The test runs a torque sweep at decreasing RPMs, or revolutions per minute, ranging from 50 to 0.3 rpm. Once the torques are recorded, custom software then calculates yield stress for each sample. A yield stress above 0.5 dyn/cm$^2$ is ideal for supporting particulates, but a yield stress above 0.2 dyn/cm$^2$ is sufficient to justify product positioning as a gel or dish gel.

ARG2 Viscosity Test—This rheological test was conducted on the ARG2 rheometer. It simply measures viscosity at a constant shear rate of 21 s$^{-1}$ with a constant temperature of 25° C. This test simulates the shear rate of the product coming out of the bottle when the consumer dispenses the product under normal conditions. If the value is above 2000 cP, the cap orifice may need to be modified to assure consumer-friendly dispensing.

TABLE 8a

| Ingredient | Ex. Ultra acidic LDL gel #1 (wt. %) | Ex. Ultra acidic LDL gel #2 (wt. %) | Ex. Ultra acidic LDL gel #3 (wt. %) |
|---|---|---|---|
| Na DBS[1] | 5.75 | 5.75 | 5.75 |
| SLES (2EO) $C_{12}$-$C_{14}$ | 19.6 | 19.6 | 19.6 |
| Laurylamidopropylbetaine | 6.6 | 6.6 | 6.6 |
| Alcohol | 4 | 4 | 4 |
| Lactic Acid | 2 | 2 | 2 |
| SXS | 2.5 | 2.5 | 2.5 |
| Gellan Gum | 0.075 | 0.094 | 0.125 |
| $Na_4EDTA$ | 0.83 | 0.83 | 0.83 |
| Water | qs | qs | qs |

[1]Sodium dodecyl benzene sulfonate

TABLE 8b

| Ultra Acidic LDL Gel | Brookfield Viscosity (cP) | ARG2 Viscosity (cP) | ARG2 Creep Yield Stress (dyn/cm$^2$) | Brookfield Yield Stress (dyn/cm$^2$) |
|---|---|---|---|---|
| #1 | 773 | 1472 | 0.16 | 0.231 |
| #2 | 768 | 1388 | 0.40 | 0.859 |
| #3 | 905 | 1778 | —[1] | 1.046 |

[1]Surface skinning over testing creep test timing cycle yielded invalidated data The liquid compositions are readily pourable and exhibit a viscosity in the range of 6 to 300 milliPascal second (mPas or mps) as measured at 25° C. with a Brookfield RVTDV-11 Viscometer using a #21 spindle rotating at 20 RPM. In certain embodiments, the viscosity is maintained in the range of 10 to 200 mPas.

Example 9

The compositions of the invention are nearly colorless. The relative amount of a coloring agent to deliver near-colorless aesthetics is mainly dependent on the color of the dodecyl benzene sulfonate being used. Color is measured on a Klett scale where the higher the Klett the more yellow a particular material used. The next table gives an approximate amount of color needed to deliver the aesthetic according to Klett of NaLAS. The formulation uses a mixture of violet and pink dyes to yield the final color aesthetic. The colors are chosen based on the color wheel. Violet dye is added to offset the light yellow color present in the base. Because it may be an imperfect match a slight green color can be generated which is accounted for with a pink colorant. The net result is a product that has an appearance of a colorless material.

TABLE 9

| Dodecyl Benzene Sulfonate Color | Wt. % Coloring Agent Added |
|---|---|
| 0-5 | <0.0035 |
| 6-10 | 0.0035 |
| 10-15 | 0.006 |
| 15-20 | 0.008 |
| 20-25 | 0.01 |

Example 10

Toxicity Testing was conducted using animal studies and alternative tests. Animal studies were completed using Table 1a formula Ultra 2a/b (with or without fragrance).

The alternate test methodologies (human testing) were done for the Inventive formula as listed in Table 1d. Studies were completed with 4 different formula/fragrance options, but the base formula is 1d. The Toxicity Testing was conducted using the following test protocols:

(1) Acute Oral Toxicity—Exposure is via a single, limit dose of dish liquid at the maximum required upper limit dose of 5000 mg/kg. The Acute Oral Toxicity was conducted using OPPTS Guideline Study 870.1100, EPA Publication #98-190. The $LD_{50}$ was not reached and was greater than 5000 mg/kg. As a comparison, two dish liquid compositions were prepared and tested. One composition contained about 0.5 wt. % of betaine, about 13 wt. % each of Na DBS, Mg DBS, and $NH_4$AEOS. The other composition contained about 0.5 wt. % of betaine, about 26 wt. % of Na DBS and about 13 wt. % of $NH_4$AEOS. The $LD_{50}$ values for the two compositions were less than 5000 mg/kg.

(2) Acute Dermal Toxicity—Exposure is via a single, limit dose of dish liquid at the upper limit dose of 5000 mg/kg. The Acute Dermal Toxicity was conducted using OPPTS Guideline Study 870.1200, EPA Publication #98-192. The $LD_{50}$ was not reached and was greater than 5000 mg/kg.

(3) Acute Eye Irritation—Exposure is via a single 10 μl dose, with scoring for irritation at fixed intervals after exposure. The Acute Eye Irritation was conducted using a lower volume of test material placed directly on the eye. The amount of test material used in the LVET is 1/10th of that used in the Draize eye irritation test. There was some initial irritation that fully reversed within the 7 day scoring endpoint, and no corneal opacity.

(4) Acute Dermal Irritation—Exposure is via repeated, occluded, prolonged exposure to concentrated (undiluted) dish liquid. The Acute Dermal Irritation was conducted using OPPTS Guideline Study 870.2500, EPA Publication #98-196. Results showed irritation within the 72 hour period that fully reversed with seven days. A more relevant measure skin irritation uses the standard 21-day Cumulative Irritation study methodology (applied commonly in the cosmetic industry) on humans. This method is a semi-occluded exposure at a relevant product use-dilution, although it is still clearly an extreme/maximal exposure scenario. This method shows no significant irritation for lactic acid based formulations.

(5) Skin Sensitization—Exposure is via three weekly induction doses and then a challenge dose (following a 2 week intervening rest period). The Skin Sensitization was conducted using OPPTS Guideline Study 870.2600, EPA Publication #98-197. A naïve control group is used as a comparison for the group receiving the challenge dose. Result is that the formula is a non-sensitizer. A more relevant measure of sensitization potential uses the Human Repeat Insult Patch Test methodology (applied commonly in the cosmetic industry) on humans. This is an occlusive patch exposure method at a relevant product use-dilution. This method also documents no skin sensitization for the sample.

All of the references cited and appended hereto, including patents, patent applications, literature publications, and the like, are hereby incorporated in their entireties by reference.

What is claimed is:

1. An acidic surfactant based cleaning composition comprising a surfactant combination, and 1 to 3% by weight of at least one organic acid, the surfactant combination consists of:

(i) sodium dodecyl benzene sulfonate, which is present in an amount of about 3 wt. % to about 20 wt. % or about 2 wt. % to about 9 wt. % by weight of the total composition, (ii) sodium lauryl ether sulfate with about two EO units, which is present in an amount of about 3 wt. % to about 20 wt. % or about 5 wt. % to about 30 wt. % by weight of the total composition, (iii) laurylamidopropyl betaine, which is present in an amount of about 1 wt. % to about 8 wt. % by weight of the total composition, wherein the composition exhibits at feast one of the following:

(i) an acute oral toxicity of about >5000 mg/kg, (ii) an acute dermal toxicity of about >5000 mg/kg, (iii) an acute eye irritation of slight corneal opacity and reversible eye irritation within 7 days, and/or (iv) an acute dermal irritation of moderate irritation at 72 hours that is reversible; and the composition is dermal non-sensitizer.

2. The acidic surfactant based cleaning composition of claim 1, wherein the organic acid is lactic acid.

3. A method of cleaning a surface comprising contacting the surface with a composition of claim 1.

4. The acidic surfactant based cleaning composition of claim 1, wherein the organic acid is at least one organic acid chosen from lactic acid, formic acid, citric acid, sorbic acid, acetic acid, glycolic acid, propanoic acid, propionic acid, oxalic acid, maleic acid, tartaric acid, adipic acid, malic acid, malonic acid, and glycolic acid.

5. The acidic surfactant based cleaning composition of claim 1, wherein the composition exhibits all of the following:

(i) an acute oral toxicity of about >5000 mg/kg, (ii) an acute dermal toxicity of about >5000 mg/kg, (iii) an acute eye irritation of slight corneal opacity and reversible eye irritation within 7 days, and (iv) an acute dermal irritation of moderate irritation at 72 hours that is reversible; and the composition is dermal non-sensitizer.

6. The acidic surfactant based cleaning composition of claim 1, wherein the surfactant combination is one of:

i) about 3.7 wt. % sodium dodecyl benzene sulfonate, about 12 wt. % sodium lauryl ether sulfate, and about 3.4 wt. % laurylamidopropyl betaine, ii) about 8.4 wt. % sodium dodecyl benzene sulfonate, about 9.2 wt. % sodium lauryl ether sulfate, and about 1.5 wt. % laurylamidopropyl betaine, iii) about 5.8 wt. % sodium dodecyl benzene sulfonate, about 19.6 wt. % sodium lauryl ether sulfate, and about 6.6 wt. % laurylamidopropyl betaine, iv) about 8.5 wt. % sodium dodecyl benzene sulfonate, about 17.9 wt. % sodium lauryl ether sulfate, and about 5.4 wt. % laurylamidopropyl betaine, v) about 8.4 wt. % sodium dodecyl benzene sulfonate, about 9.3 wt. % sodium lauryl ether sulfate, and about 1.5 wt. % laurylamidopropyl betaine, vi) about 3.7 wt. % sodium dodecyl benzene sulfonate, about 12.1 wt. % sodium lauryl ether sulfate, and about 3.4 wt. % laurylamidopropyl betaine, vii) about 5.75 wt. % sodium dodecyl benzene sulfonate, about 19.6 wt. % sodium lauryl ether sulfate, and about 6.6 wt. % laurylamidopropyl betaine, viii) about 5.3 wt. % sodium dodecyl benzene sulfonate, about 5.8 wt. % sodium lauryl ether sulfate, and about 0.1 wt. % laurylamidopropyl betaine, ix) about 2.3 wt. % sodium dodecyl benzene sulfonate, about 7.6 wt. % sodium lauryl ether sulfate, and about 2.2 wt. % laurylamidopropyl betaine, x) about 12.7 wt. % sodium dodecyl benzene sulfonate, about 13.7 wt. % sodium lauryl ether sulfate, and about 5.6 wt. % laurylamidopropyl betaine, xi) about 4 wt. % sodium dodecyl benzene sulfonate, about 13 wt. % sodium lauryl ether sulfate, and about 3.7 wt. % laurylamidopropyl betaine, xii) about 5.7 wt. % sodium dodecyl benzene sulfonate, about 18.9 wt. % sodium lauryl ether sulfate, and about 5.4 wt. % laurylamidopropyl betaine, xiii) about 10 wt. % sodium dodecyl benzene sulfonate, about 21 wt. % sodium lauryl ether sulfate, and about 3.6 wt. % laurylamidopropyl betaine, or xiv) about 6.4 wt. % sodium dodecyl benzene sulfonate, about 24.6 wt. % sodium lauryl ether sulfate, and about 3.6 wt. % laurylamidopropyl betaine.

7. The acidic surfactant based cleaning composition of claim 6, wherein the organic acid comprises lactic acid.

8. The acidic surfactant based cleaning composition of claim 7, wherein the lactic acid is present at 2 wt. %.

* * * * *